US006564985B1

(12) United States Patent
Chou

(10) Patent No.: US 6,564,985 B1
(45) Date of Patent: May 20, 2003

(54) CARTRIDGE ASSEMBLY FOR A NAIL DRIVING GUN

(76) Inventor: Kun-Chuan Chou, No. 3, Alley 2, Lane 214, Peng-Yi Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 10/309,446

(22) Filed: Dec. 3, 2002

(51) Int. Cl.[7] ..... B25C 1/04
(52) U.S. Cl. ..... 227/109; 227/120
(58) Field of Search ..... 227/109, 120, 227/119, 136, 135

(56) References Cited

U.S. PATENT DOCUMENTS 3,834,602 A * 9/1974 Obergfell ..... 227/109
5,522,533 A * 6/1996 Mukoyama et al. ..... 227/109
5,632,431 A * 5/1997 Lin ..... 227/120
5,692,665 A * 12/1997 Lee ..... 227/119
5,873,509 A * 2/1999 Liao ..... 227/120
5,934,539 A * 8/1999 Lee ..... 227/109
5,967,396 A * 10/1999 Chuang ..... 227/120
6,161,746 A * 12/2000 Wey ..... 227/109

* cited by examiner

*Primary Examiner*—Scott A. Smith
(74) *Attorney, Agent, or Firm*—Christie, Parker & Hale, LLP

(57) ABSTRACT

A cartridge assembly includes left and right cartridge halves respectively having left and right side faces that cooperatively define a nail-receiving chamber therebetween. A plurality of spring-biased nail pushers are received in the nail-receiving chamber. Top ends of the nail pushers-are flush with one another so as to form a continuous supporting face to bias a nail in a stable manner.

4 Claims, 10 Drawing Sheets

CARTRIDGE ASSEMBLY FOR A NAIL DRIVING GUN

BACKGROUND OF THE INVENTION

1. Field of the Invention

The invention relates to a nail driving gun, more particularly to a cartridge assembly that is adapted to be connected to a nail-discharging plate of a nail driving gun and that is adapted to feed nails into a nail-discharging track formed in the nail-discharging plate in a stable manner.

2. Description of the Related Art

In a known nail driving gun, a nail feeding unit aligns a nail from a cartridge assembly with a nail impelling unit so as to discharge the nail via a nail-discharging track.

Referring to FIGS. 1 and 2, a conventional nail driving gun 10 is shown to include a gun housing 100, a nail-discharging plate 101 projecting forwardly from the gun housing 100 and formed with a nail-discharging track 102 extending in a longitudinal direction, and a cartridge assembly connected securely to a rear portion 101R of the nail-discharging plate 101 for supplying nails in succession into the nail-discharging track 102.

As illustrated, the cartridge assembly includes a left cartridge half 11, a right cartridge half 12, a plurality of urging members 16, a primary pusher 14, and a plurality of secondary pushers 15. The left cartridge half 11 has a left side face 113 formed with a plurality of retention grooves 111 adjacent to the rear portion 101R thereof and extending in a transverse direction relative to the longitudinal direction. A leading plate 13 is fixed on the left side face 113 of the left cartridge half 11 to form a leading chamber 13" therebetween adjacent to a front portion 101F of the nail-discharging plate 101. The right cartridge. half 12 is coupled to the left cartridge half 11, and has a right side face 120 confronting and spaced apart from the left side face 113 to define a nail-receiving chamber 131 in alignment with and in spatial communication with the leading chamber 13" (see FIG. 3). The leading chamber 13" and the nail-receiving chamber 131 are in vertical alignment and in spatial communication with the nail-discharging track 102. The right side face 120 of the right cartridge half 12 is formed with a plurality of spaced apart spring-receiving grooves 121, each of which extends in the transverse direction and each of which is in spatial communication with a respective one of the retention grooves 111 in the left cartridge half 11 through the nail-receiving chamber 131. The urging members 16 are respectively disposed in the spring-receiving grooves 121 in the right cartridge half 12.

The primary pusher 14 is received movably in the leading chamber 13", and is connected to a corresponding one of the urging members 16 so as to be urged to move in the transverse direction. Each of the secondary pushers 15 includes a nail-pushing plate 150 disposed in the nail-receiving chamber 131, and connected to a respective one of the urging members 16 so as to be urged to move in the transverse direction. Each of the nail-pushing plates 150 has a distal portion 150D extending into a respective one of the retention grooves 111 in the left cartridge half 11, a front end face 150F (see FIG. 3), and a rear end face 150R that is spaced apart from the front end face 150F of an adjacent one of the nail-pushing plates 150 to form a gap 13G (see FIG. 3) therebetween.

Referring to FIGS. 2 and 4, when a row of nails 20 is placed in the nail-receiving chamber 131 so as to be pushed upward toward the nail-discharging track 102 by the top ends of the pushers 14, 15, due to the presence of the gaps 13G between an adjacent pair of the nail-pushing plates 150, the nail 20 cannot be properly supported.

SUMMARY OF THE INVENTION

Therefore, the object of this invention is to provide a nail driving gun with a cartridge assembly that is adapted to support nails in a stable manner so as to overcome the aforementioned drawback that is generally associated with the conventional nail driving gun.

Accordingly, a cartridge assembly of the present invention is adapted to be connected to a nail-discharging plate of a nail driving gun for supplying nails into a nail-discharging track formed in the nail-discharging plate. The nail-discharging track extends in a longitudinal direction. The cartridge assembly includes a left cartridge half, a right cartridge half, a plurality of urging members, and a plurality of pushers. The left cartridge half is formed with a left side face. The right cartridge half is coupled to the left cartridge half, and has a right side face confronting and spaced apart from the left side face to define a nail-receiving chamber therebetween. The nail-receiving chamber is adapted to be in vertical alignment and in spatial communication with the nail-discharging track. The right side face of the right cartridge half is formed with a plurality of spaced apart spring-receiving grooves, each of which extends in a transverse direction relative to the longitudinal direction and each of which is in spatial communication with the nail-receiving chamber. The urging members are respectively disposed in the spring-receiving grooves. Each of the pushers includes a nail-pushing plate received movably in the nail-receiving chamber. The nail-pushing plates of the pushers are respectively connected to the urging members so as to be urged by the urging members to move in the transverse direction. Each of the nail-pushing plates has a cross-section extending in the longitudinal direction. The cross-section of each of the nail-pushing plates has a first portion aligned with a respective one of the spring-receiving grooves, and a second portion extending from the first portion in the longitudinal direction between two adjacent ones of the spring receiving grooves.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENTS

Figure 1:
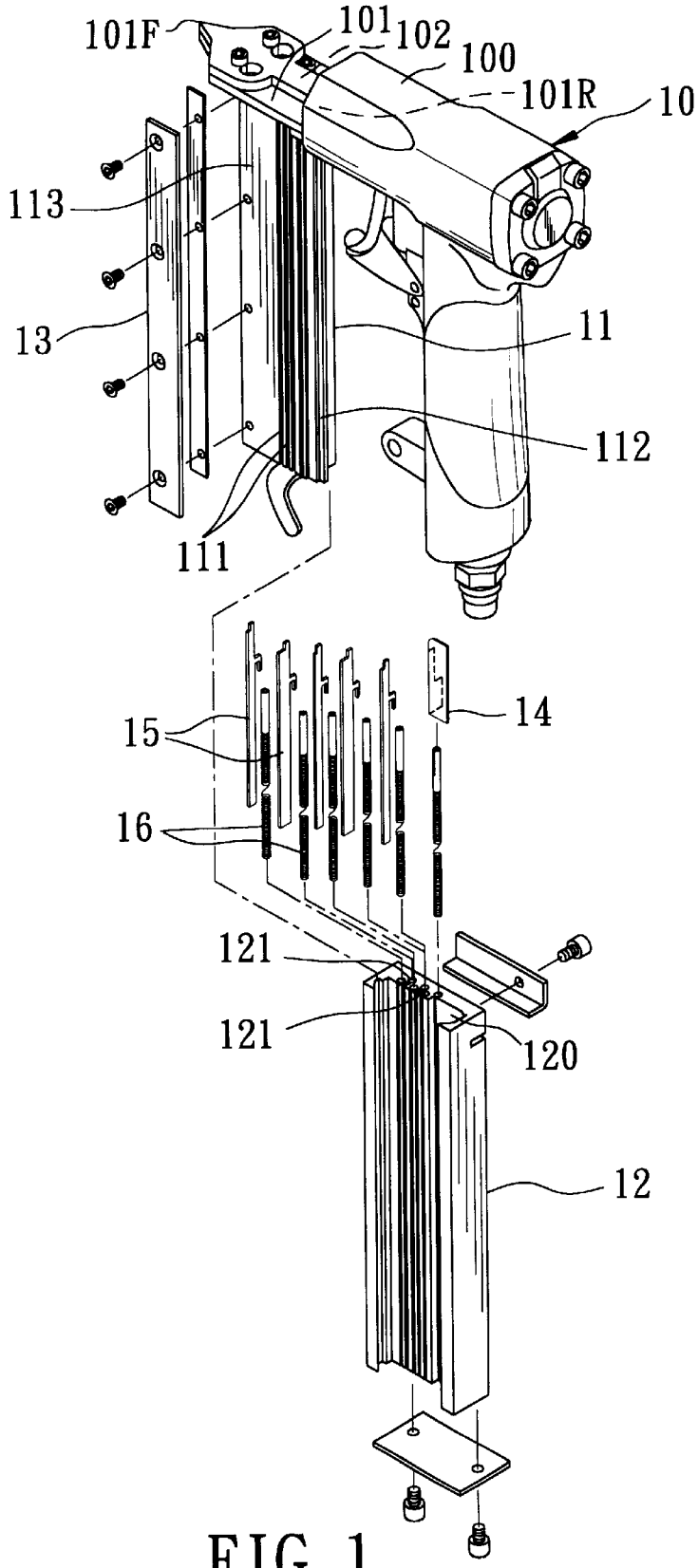
FIG. 1 PRIOR ART
FIG. 1 is a perspective view of a conventional nail driving gun, wherein a cartridge assembly employed therein is partly exploded to illustrate the construction thereof.
Figure 2:
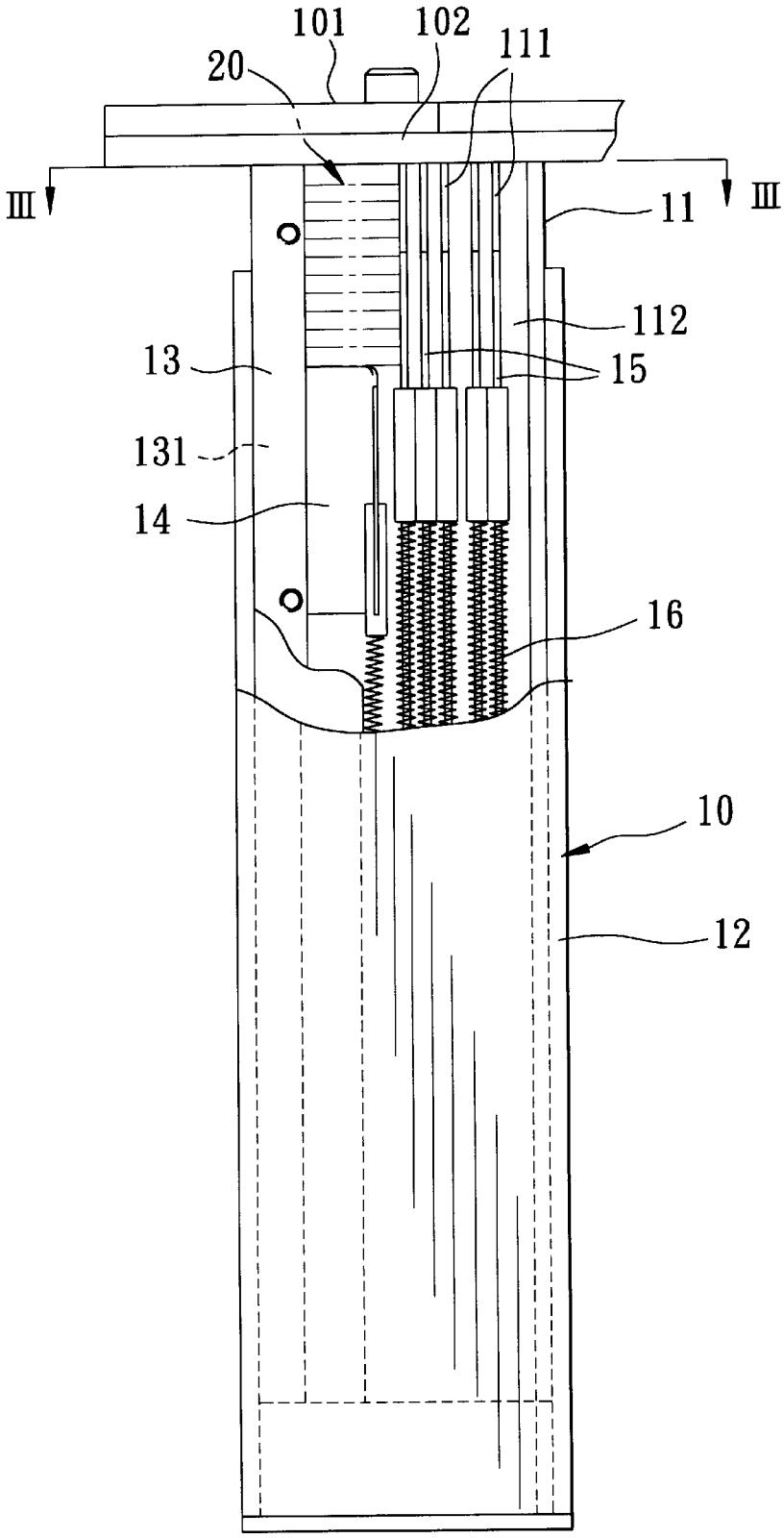
FIG. 2 PRIOR ART
FIG. 2 is a fragmentary side view of the cartridge assembly employed in the conventional nail driving gun, illustrating how a row of short nails is pushed by a plurality of pushers toward a nail-discharging track.
Figure 3:
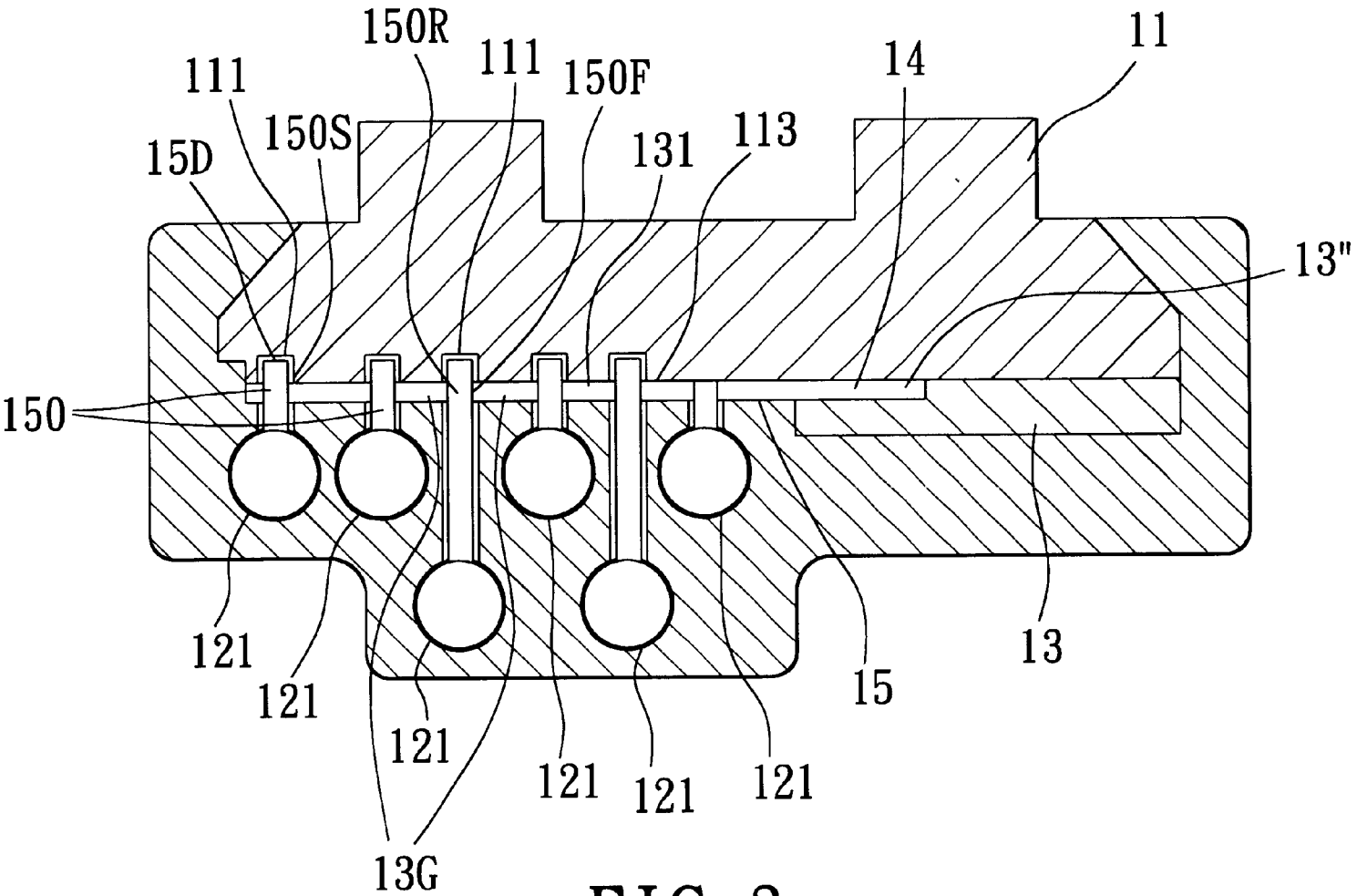
FIG. 3 PRIOR ART
FIG. 3 is a top view of the cartridge assembly taken along lines III—III in FIG. 2.
Figure 4:
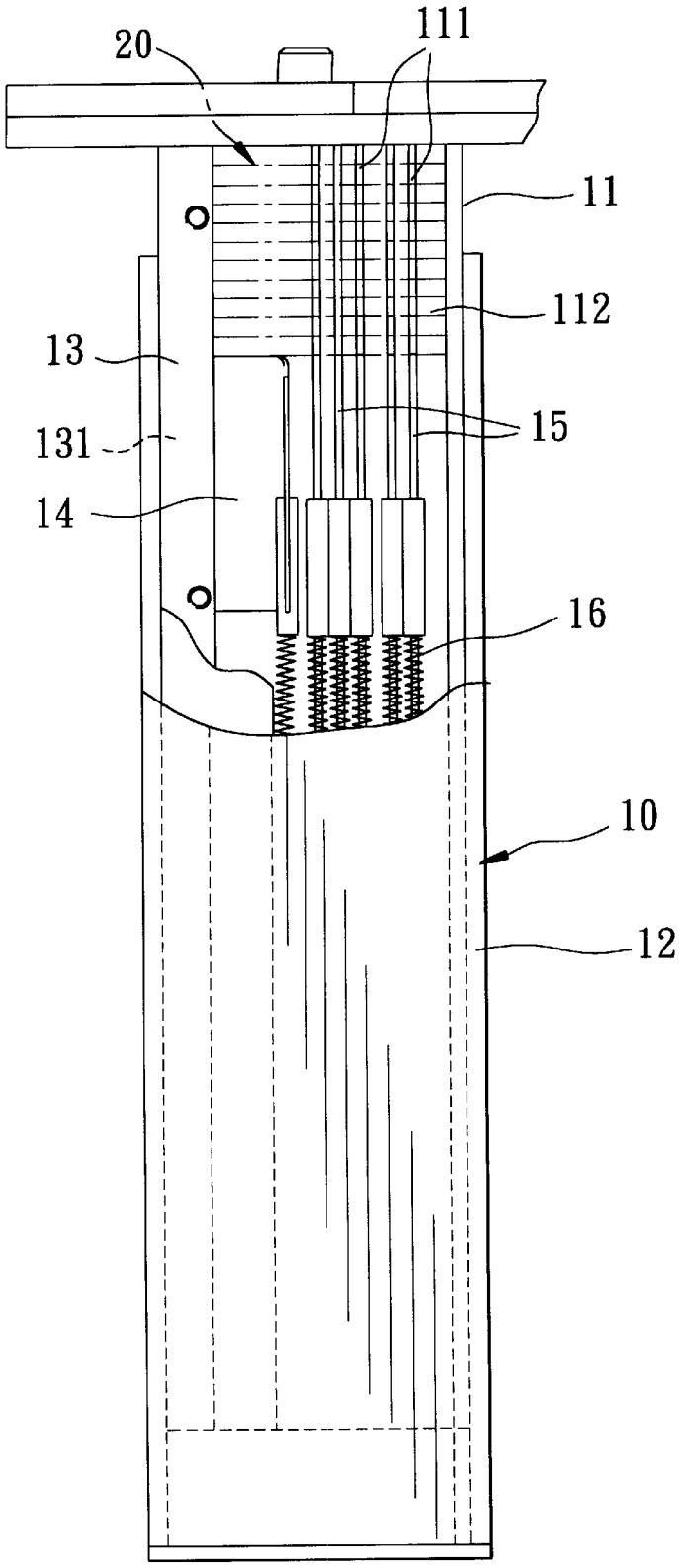
FIG. 4 PRIOR ART
FIG. 4 is a fragmentary side view of the cartridge assembly employed in the conventional nail driving gun, illustrating how a row of long nails is pushed by the plurality of pushers toward the nail-discharging track.
Figure 5:
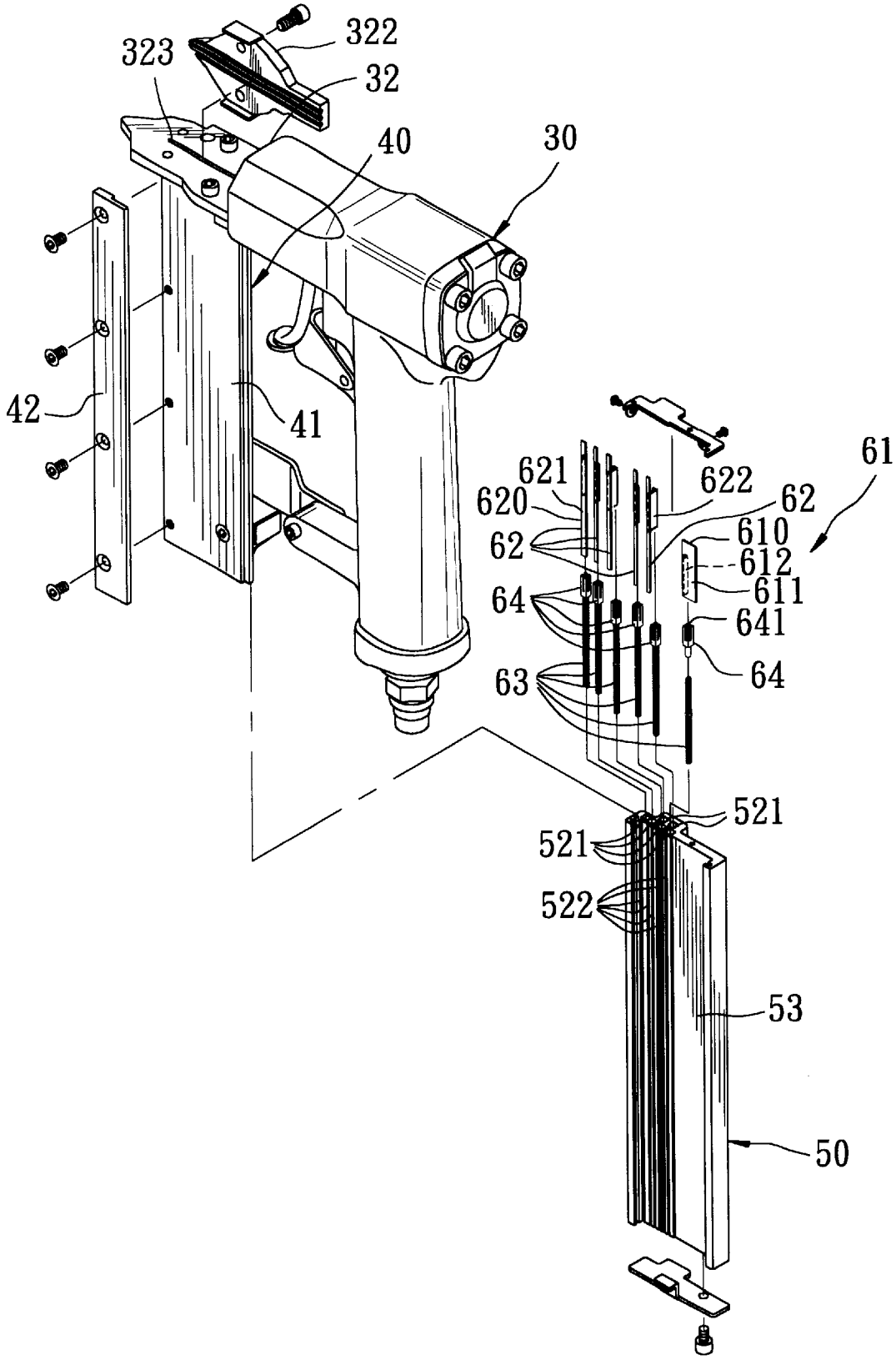
FIG. 5 is an exploded perspective view of a preferred embodiment of a nail driving gun according to the present invention.
Figure 6:
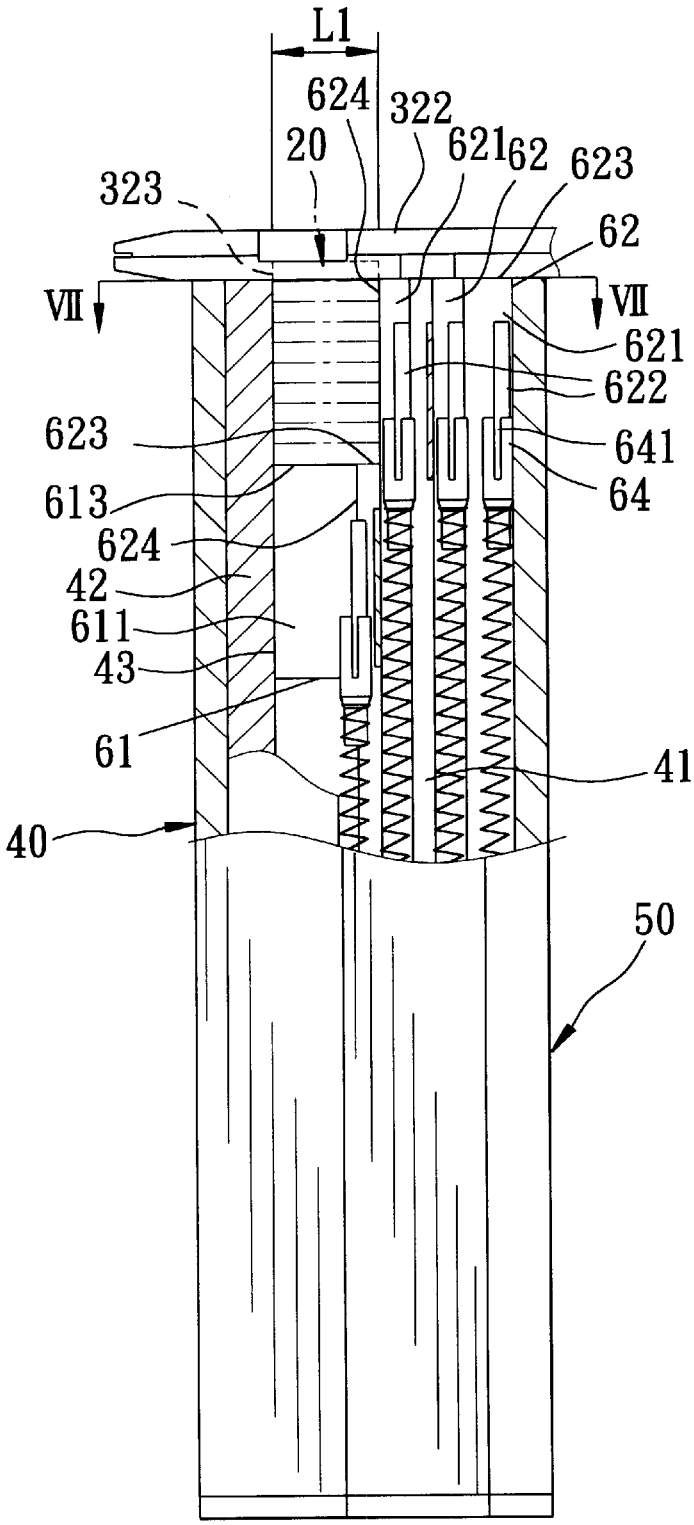
FIG. 6 is a fragmentary side view of the cartridge assembly employed in the nail driving gun of the present invention, illustrating how a row of short nails is pushed by combination of a spring-biased primary pusher and one of a plurality of spring-biased secondary pushers toward a nail-discharging track.
Figure 7:
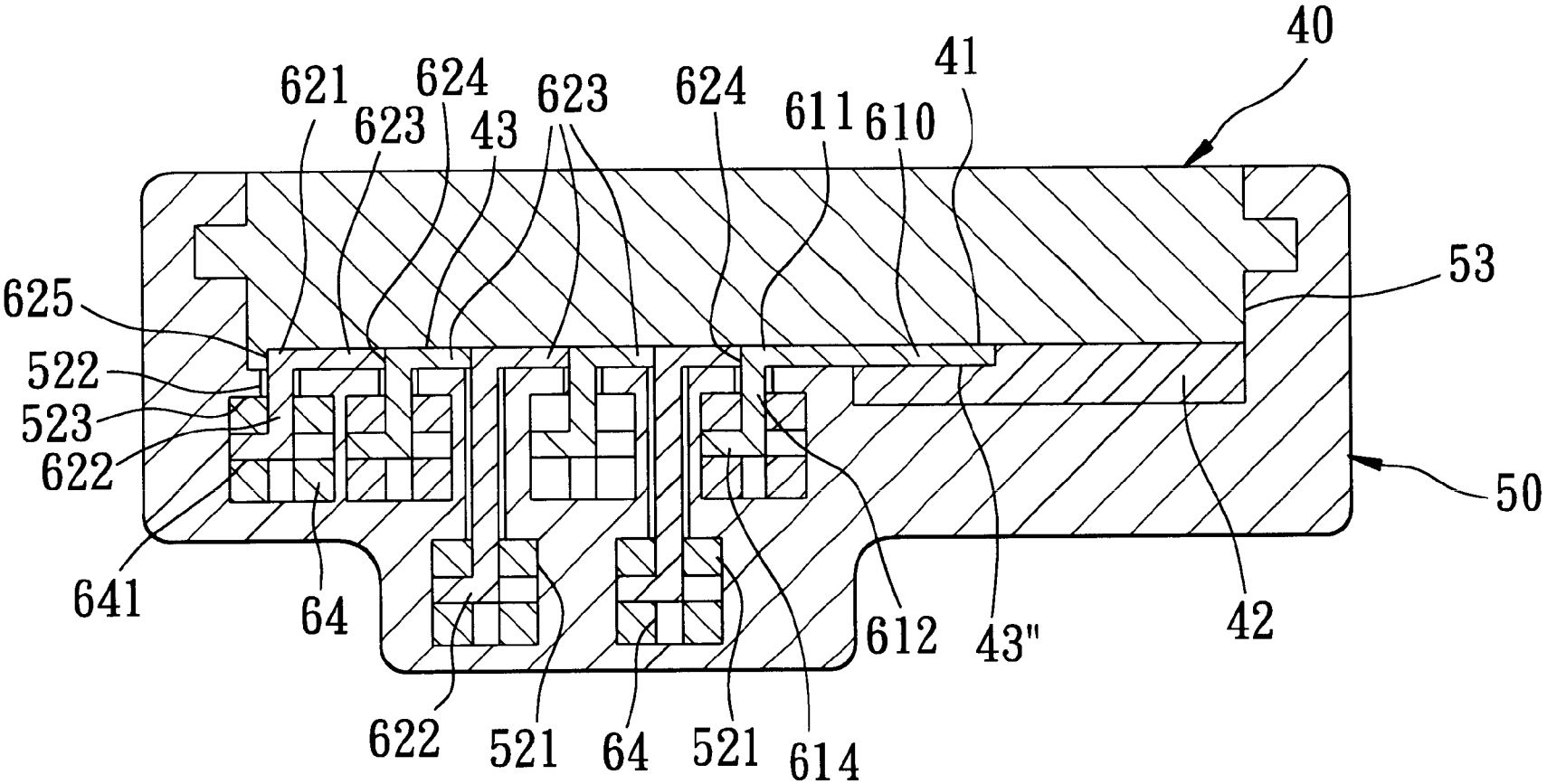
FIG. 7 is a top view of the cartridge assembly taken along lines VII—VII in FIG. 6.

Referring to FIGS. 5, 6 and 7, the first preferred embodiment of a cartridge assembly of the present invention is adapted to be connected to a nail-discharging plate 32 of a nail driving gun 30, and is shown to include a left cartridge half 40, a right cartridge half 50, a plurality of urging members 63, a primary pusher 61, and a plurality of secondary pushers 62.

As illustrated, the nail-discharging plate 32 is formed with a nail-discharging track 323 that extends in a longitudinal direction.

A cover plate 322 is superimposed on a top face of the nail-discharging plate 32 to cover the nail-discharging track 323. The cartridge assembly is connected securely to the nail-discharging plate 32 for supplying nails 20 in succession into the nail-discharging track 323 in the nail-discharging plate 32. A nail impelling unit (not shown) is provided to impel the nail 20 in the nail-discharging track 102 upon actuation thereof. Since the features of the present invention do not reside in the structure of the impelling unit, a detailed description of the same is omitted herein for the sake of brevity.

The left cartridge half 40 is connected securely to the nail-discharging plate 32, and is formed with a left side face 41.

A leading plate 42 is fixed onto the left side face 41 of the left cartridge half 41 to form a leading chamber 43" in such a manner that the leading chamber 43 is located adjacent to a front portion of the nail-discharging plate 32.

The right cartridge half 50 is slidably coupled to the-left cartridge half 40, and,has a right side face 53 confronting with and spaced apart from the left side face 41 to define a nail-receiving, chamber 43 therebetween. The leading chamber 43" and the nail-receiving chamber 43 are in vertical alignment and in spatial communication with the nail-discharging track 323 in the nail-discharging plate 32. The right side face 53 of the right cartridge half 50 is formed with a plurality of spaced apart spring-receiving grooves 521, 522, each of which extends in a transverse direction relative to the longitudinal direction and each of which is in spatial communication with the nail-receiving chamber 43.

The urging members 63, which are coiled compression springs, are respectively disposed in the spring-receiving grooves 521, 522.

The primary pusher 61 includes a nail-pushing plate 610 movably received in the leading chamber 43" and connected to a corresponding one of the urging member 63 so as to be urged by the corresponding urging members 63 to move in the transverse direction. The nail-pushing plate 610 has a cross-section extending in the longitudinal direction. Each of the secondary pushers 62 includes a nail-pushing plate 620 received movably in the nail-receiving chamber 43. The nail-pushing plates 620 of the secondary pushers 62 are respectively connected to the urging members 63 so as to be urged by the urging members 63 to move in the transverse direction. Each of the nail-pushing plates 620 has a cross-section extending in the longitudinal direction. The cross-section of each of the nail-pushing plates 620 has a first portion 621 aligned with a respective one of the spring-receiving grooves 522, and a second portion 623 extending from the first portion 621 in the longitudinal direction between two adjacent ones of the spring-receiving grooves 522.

Figure 8:
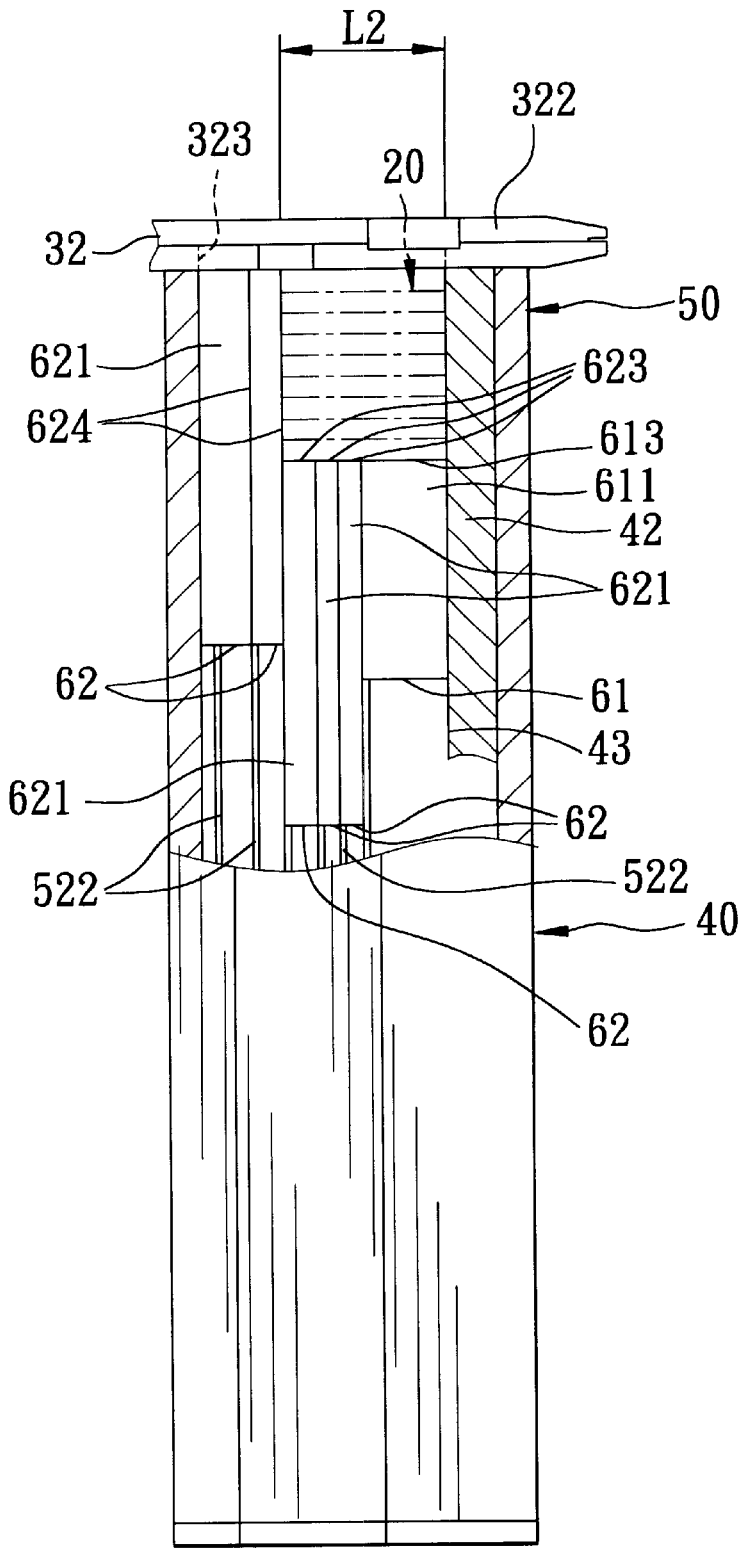
FIG. 8 is a fragmentary side view of the cartridge assembly employed in the nail driving gun of the present invention, illustrating how a row of nails is pushed by combination of the spring-biased primary pusher and two of the spring-biased secondary pushers toward the nail-discharging track.
Figure 9:
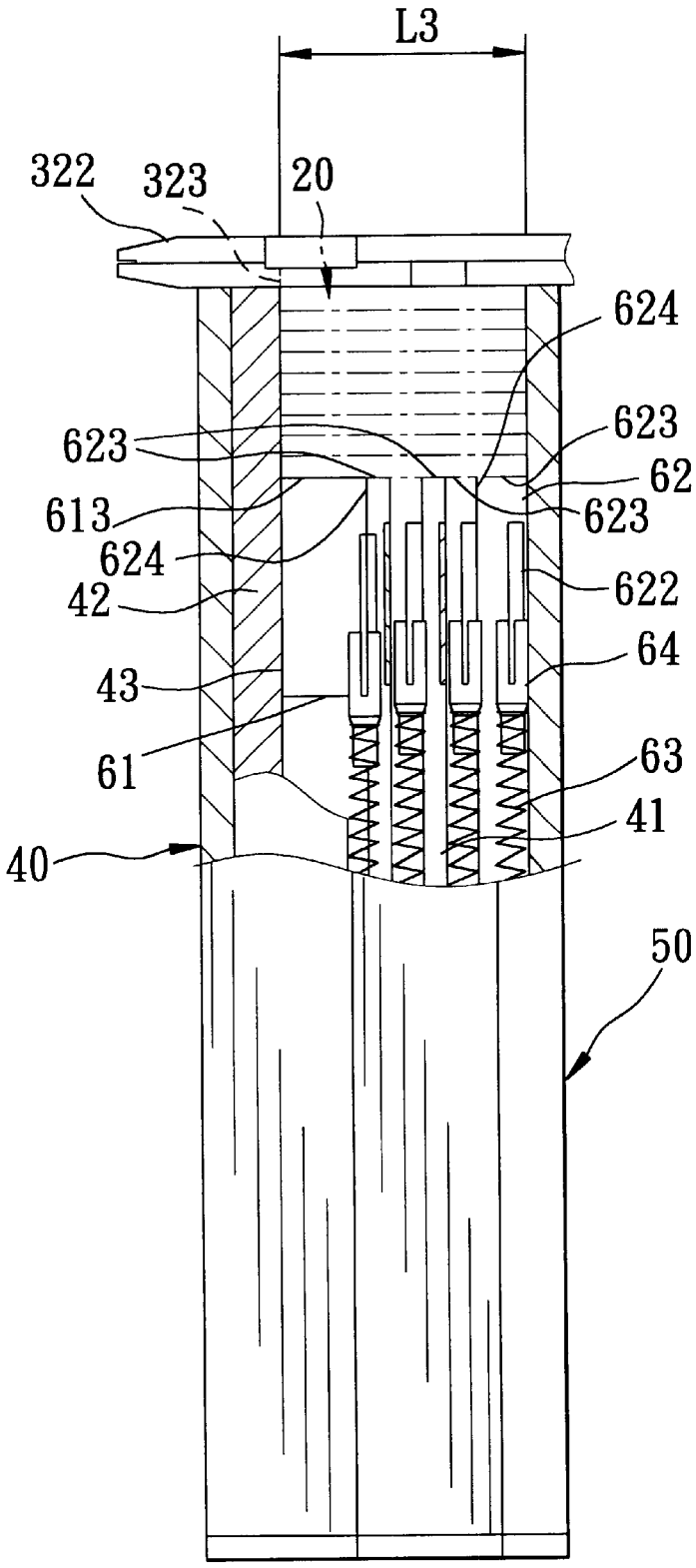
FIG. 9 is a fragmentary side view of the cartridge assembly employed in the nail driving gun of the present invention, illustrating how a row of long nails is pushed by combination the spring-biased primary pusher and four of the spring-biased secondary pushers.

In the first preferred embodiment, each of the spring-receiving grooves 521, 522 has a rectangular cross-section. The cartridge assembly further includes a plurality of mounting blocks 64 of rectangular cross-section, which are respectively disposed in the spring-receiving grooves 521, 522. Each of the mounting blocks 64 is connected to a respective one of the urging members 63 and is formed with an L-shaped retaining groove 641. Each of the primary pusher 61 and the secondary pushers 62 further includes an L-shaped connecting plate 614, 622 retained in the retaining groove 641 in a respective one of the mounting blocks 64 and connected to a respective one of the nail-pushing plates 610, 620 at the first portion 611, 621 of the cross-section of the respective one of the nail-pushing plates 610, 620. In addition, each of the nail-pushing plates 610, 620 has a top face, and front and rear end faces 624, 625 (see FIG. 7). The front end face 624 of each of the nail-pushing plates 610, 620 is in sliding contact with the rear end face 625 of an adjacent one of the nail-pushing plates 610, 620 such that the top faces of the nail-pushing plates 610, 620 form a continuous pushing face when the top faces are flush with one another. Since the top ends of the primary pusher 61 and the secondary pushers 62 are used to bias the nail 20 toward the nail-discharging track 323 in the nail-discharging plate 32 and because the top ends of the nail-pushing plates 610, 620 of the primary pusher 61 and the secondary pushers 62 are flush with one another to cooperatively form a continuous flat support face, the nails 20 will be biased in a stable manner. FIG. 6 illustrates a state in which a row of nails 20 with a length of "L1 " is biased by the primary pusher 61 and one of the secondary pushers 62 toward the nail-discharging track 323. FIG. 8 illustrates a state in which the row of nails 20 with a length of "L2" is biased by the primary pusher 61 and two of the secondary pushers 62. FIG. 9 illustrates a state in which the row of nails 20 with a length of "L3" is biased by the primary pusher 61 and four of the secondary pushers 62 toward the nail-discharging track 323.

Figure 10:
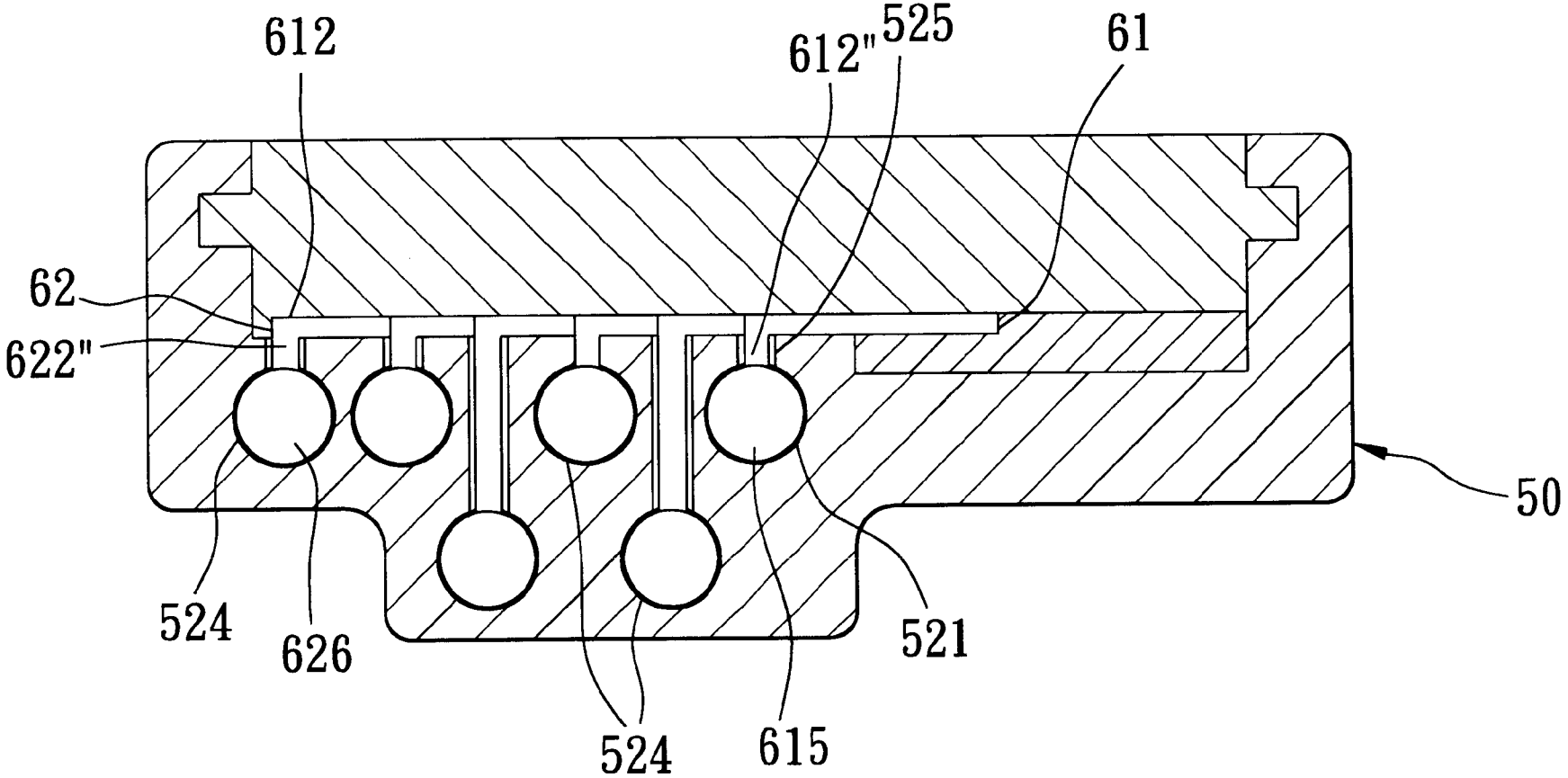
FIG. 10 is a top view of a modified cartridge assembly employed in the nail driving gun according to the present invention.

Referring to FIG. 10, a second preferred embodiment of the cartridge assembly according to the present invention is shown to have a structure similar to that of the previous preferred embodiment. The main difference resides in that each of the spring-receiving grooves 521, 524 in the right cartridge half 50 is circular in cross-section. The cartridge assembly includes a plurality of cylindrical mounting blocks 615, 626 respectively and movably disposed in the spring-receiving grooves 521, 524. Each of the mounting blocks 615, 626 is connected to a respective one of the urging members 63 (not visible). Each of the pushers 61, 62 includes a straight connecting plate 612", 622" extending from the first portion 611, 621 of the cross-section of the respective one of the nail-pushing plates 610, 620, and connected securely to a respective one of the cylindrical mounting blocks 615, 626.

With this invention thus explained, it is apparent that numerous modifications and variations can be made without departing from the scope and spirit of this invention. It is therefore intended that this invention be limited only as indicated in the appended claims.

I claim:

1. A cartridge assembly for a nail driving gun having a nail-discharging plate that is formed with a nail-discharging track which extends in a longitudinal direction, said cartridge assembly being adapted to be connected securely to the nail-discharging plate for supplying nails into the nail-discharging track, said cartridge assembly comprising:

a left cartridge half formed with a left side face;

a right cartridge half coupled to said left cartridge half, and having a right side face confronting and spaced apart from said left side face to define a nail-receiving chamber therebetween, said nail-receiving chamber being adapted to be in vertical alignment and in spatial communication with the nail-discharging track, said right side face of said right cartridge half being formed with a plurality of spaced apart spring-receiving grooves, each of which extends in a transverse direction relative to the longitudinal direction and each of which is in spatial communication with said nail-receiving chamber;

a plurality of urging members respectively disposed in said spring-receiving grooves; and a plurality of pushers, each of which includes a nail-pushing plate received movably in said nail-receiving chamber, said nail-pushing plates of said pushers being respectively connected to said urging members so as to be urged by said urging members to move in the transverse direction, each of said nail-pushing plates having a cross-section extending in the longitudinal direction, said cross-section of each of said nail-pushing plates having a first portion aligned with a respective one of said spring-receiving grooves, and a second portion extending from said first portion in the longitudinal direction between two adjacent ones of said spring-receiving grooves.

2. The cartridge assembly as defined in claim 1, wherein each of said spring-receiving grooves has a rectangular cross-section, said cartridge assembly further comprising a plurality of mounting blocks of rectangular cross-section respectively disposed in said spring-receiving grooves, each of said mounting blocks being connected to a respective one of said urging members and being formed with an L-shaped retaining groove, each of said pushers further including an L-shaped connecting plate retained in said retaining groove in a respective one of said mounting blocks and connected to a respective one of said pushing plates at said first portion of said cross-section of the respective one of said nail-pushing plates.

3. The cartridge assembly as defined in claim 2, wherein each of said nail-pushing plates has a top face and front and rear end faces, said front end face of each of said nail-pushing plates being in sliding contact with said rear end face of an adjacent one of said nail-pushing plates such that said top faces of said nail-pushing plates form a continuous pushing face when said top faces of said nail-pushing plates are flush with one another.

4. The cartridge assembly as defined in claim 1, wherein each of said spring-receiving grooves is circular cross-section, said cartridge assembly further comprising a plurality of cylindrical mounting blocks respectively disposed in said spring-receiving grooves, each of said mounting blocks being connected to a respective one of said urging members, each of said pushers further including a straight connecting plate extending from a respective one of said pushers at said first portion of said cross-section of the respective one of said nail-pushing plates and connected securely to a respective one of said cylindrical mounting blocks.

* * * * *